United States Patent [19]

Meyer et al.

[11] Patent Number: 4,986,051

[45] Date of Patent: Jan. 22, 1991

[54] ROOF TRUSS AND BEAM THEREFOR

[76] Inventors: Dolph A. Meyer, 4 Marook Street, Carlingford, New South Wales, Australia, 2118; Wyatmodjo Sardjono, 29 Edward Street, Ryde, New South Wales, Australia, 2112

[21] Appl. No.: 449,967

[22] PCT Filed: Jun. 14, 1988

[86] PCT No.: PCT/AU88/00188

§ 371 Date: Dec. 11, 1989

§ 102(e) Date: Dec. 11, 1989

[87] PCT Pub. No.: WO88/09854

PCT Pub. Date: Dec. 15, 1988

[30] Foreign Application Priority Data

Jun. 12, 1987 [AU] Australia ..... PI2444

[51] Int. Cl.[5] ..... E04C 3/30

[52] U.S. Cl. ..... 52/738; 52/693; 52/732

[58] Field of Search ..... 52/690, 693, 730, 731, 52/732, 738, 702, 737, 739

[56] References Cited

U.S. PATENT DOCUMENTS

| | | | |
|---|---|---|---|
| 3,029,914 | 4/1962 | Macomber | 52/732 |
| 3,541,749 | 11/1970 | Troutner | 52/732 |
| 3,686,819 | 8/1972 | Atkinson | 52/693 |
| 4,141,191 | 2/1979 | Aarons | 52/702 |

*Primary Examiner*—Neill R. Wilson

*Attorney, Agent, or Firm*—Ladas & Parry

[57] ABSTRACT

The upper chord of a metal roof truss which comprises an elongated beam (10) formed of rolled form metal strip which is of a constant cross-section having longitudinally extending portions (13, 14, 15 and 16) providing flat surfaces of such dimensions that with the application of excessive load upon the beam breakdown of substantially all of said portions occurs simultaneously, and wherein most of the flat surfaced portions are of a width not exceeding that which will comply with following formula (I), where: $F_a$=maximum permissible compression stress expressed in Mpa, $\Omega$=load factor, Q=form factor which allows for the effective cross-sectional area, $F_{oc}$=elastic buckling stress expressed in Mpa, $F_y$=yield stress expressed in Mpa.

8 Claims, 4 Drawing Sheets

ROOF TRUSS AND BEAM THEREFOR

This invention relates to roof trusses and beams for use therein.

BACKGROUND ART

It is a common present-day practice to prefabricate the frames of domestic dwellings, and other houses and buildings, and preassembled roof trusses are in frequent use. The transport and handling of timber roof trusses sometimes incurs damage thereto as they are somewhat unstable before on site erection in a roof. For this reason, as well as to reduce the cost and/or increase the strength, efforts have been made to produce metal roof trusses. A recently developed metal roof truss now in use is often preferred to its timer predecessors. However, it is of hollow section and a welding operation is included in its production.

DISCLOSURE OF INVENTION

A principal object of the invention is to provide a metal roof truss and a principal beam therefor which are superior in strength and cheaper in production cost as compared with conventional timber and metal beams and trusses.

In accordance with the invention there is provide a structural beam for use as an upper chord in a roof truss and composed of rolled form metal strip material having in cross-section a shape including a plurality of longitudinally extending integral portions, said beam comprising a first roof batten-fixing portion, a pair of parallel portions beneath and substantially perpendicular to said first portion and spaced apart less than the width of said first portion, and providing means for connection of said chord to the upper end of one or more spaced web members, a pair of inclined portions interconnecting the upper ends of respective ones of said parallel portions to adjacent lateral edges of said first portion, a flange portion having an outer return flange and extending outwardly at substantially right angles from the lower end of each of said parallel portions, and longitudinally extending reinforcing ribs formed in said first portion and in each of said inclined portions, the design of said beam being such that with the application of excessive load upon the beam in its use as an upper chord of a roof truss breakdown of substantially all of said portions of the cross-sectional shape occurs simultaneously.

BRIEF DESCRIPTION OF DRAWINGS

The invention will be described in more detail with reference to the accompanying drawings, in which.

BEST MODE OF CARRYING OUT THE INVENTION

Figure 1:
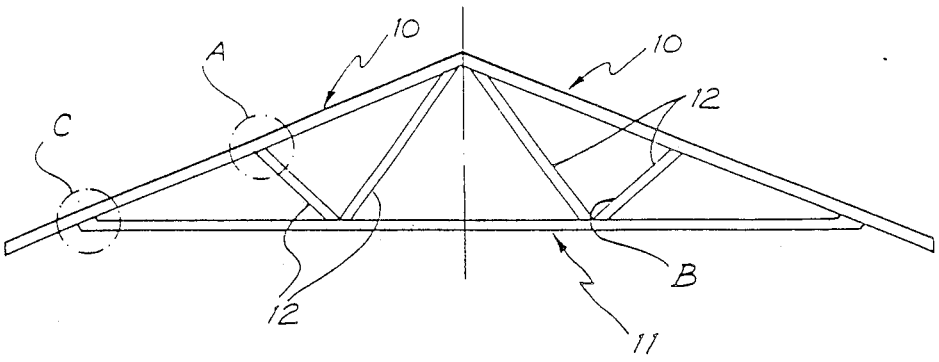
FIGS. 1 and 2 show in side elevation two forms of roof trusses that may be achieved by the present invention.
Figure 2:
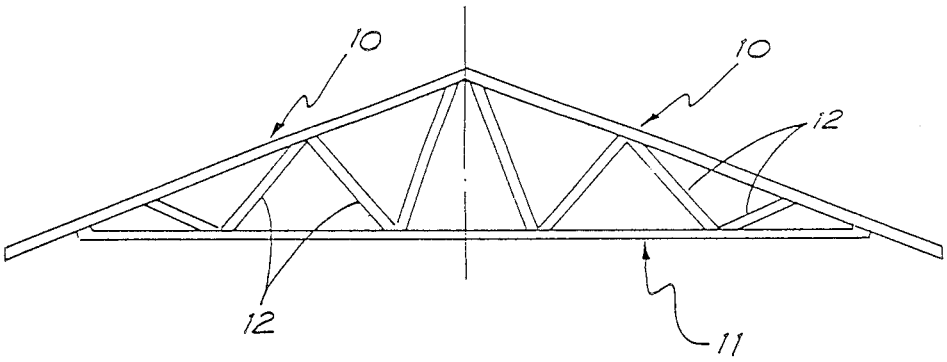

The principal aim of the invention being to reduce the cost, and increase the strength, of a roof truss, the invention has evolved in the following manner. A conventional metal beam presently in use with roof trusses has been analysed and found to be constructed from 300 Mpa mild steel strip material of 230 mm width and 0.9 mm thickness. The conventional beam has been approved by government authority to be of adequate strength for roof trusses such as shown in FIGS. 1 and 2, wherein the upper chord 10 is constituted by the beam of this invention and is supported from a lower chord 11 by web members 12. When erected upon a building the lower chord 11 spans wall frames (not shown) and is fixed thereon so that a load carried upon the upper chords 10, which are intended as roof batten fixing portions for the roof, are subjected to axial compressive force as well as bending moment where engaged by the web members 12. However, with adequate design to sustain axial compressive strain derived from the intended use it has been found that the bending moment can be ignored if conventional spacing of webs 12 is adhered to. 300 Mpa mild steel strip material of the same width, viz. 230 mm, but of a thickness of 0.7 mm was folded along longitudinal lines to a great many different cross-sectional shapes in which uninterrupted flat portions thereof were of a width not exceeding that which will coply with the following formula which relates to the cross-sectional area of the mild steel strip necessary to resist axial compression stress.

$$F_a = \frac{\Omega F_y}{\Omega}\left[\left(\frac{1.25 + \frac{F_{oc}}{QF_y}}{2}\right) - \sqrt{\left(\frac{1.25 + \frac{F_{oc}}{QF_y}}{2}\right)^2 - \frac{F_{oc}}{QF_y}}\right]$$

where $F_a$=maximum permissible compression stress expressed in Mpa $\Omega$=load factor Q=form factor which allows for the effective cross-sectional area $F_{oc}$=elastic buckling stress express in Mpa $F_y$=yield stress expressed in Mpa For the use of this formula reference should be made to the Australian Standard known as SAA cold formed steel structure code numer AS1538/1974. The above formula is, therefore, used to determine the width of flat portions as related to the 0.7 mm thickness corresponding to the desired load-carrying capacity of the beam. Such portions are portions 13, 14, 15 and 16 shown in FIG. 3. The surfaces 14 being supported by the web 12, as hereafter described, need not necessarily comply with the formula. It will be seen from this figure that construction of the trusses of FIGS. 1 and 2 involve spacing apart of the portions 14 to allow a rectangular section metal web 12 to pass between and engage by its end 12A the underside of the portion 16. A fixing bolt 17 secures the web 12 in position with respect to the chord 10. Thus, support for the load imposed upon the chord 10 is provided by the bolt 17.

Figure 3:
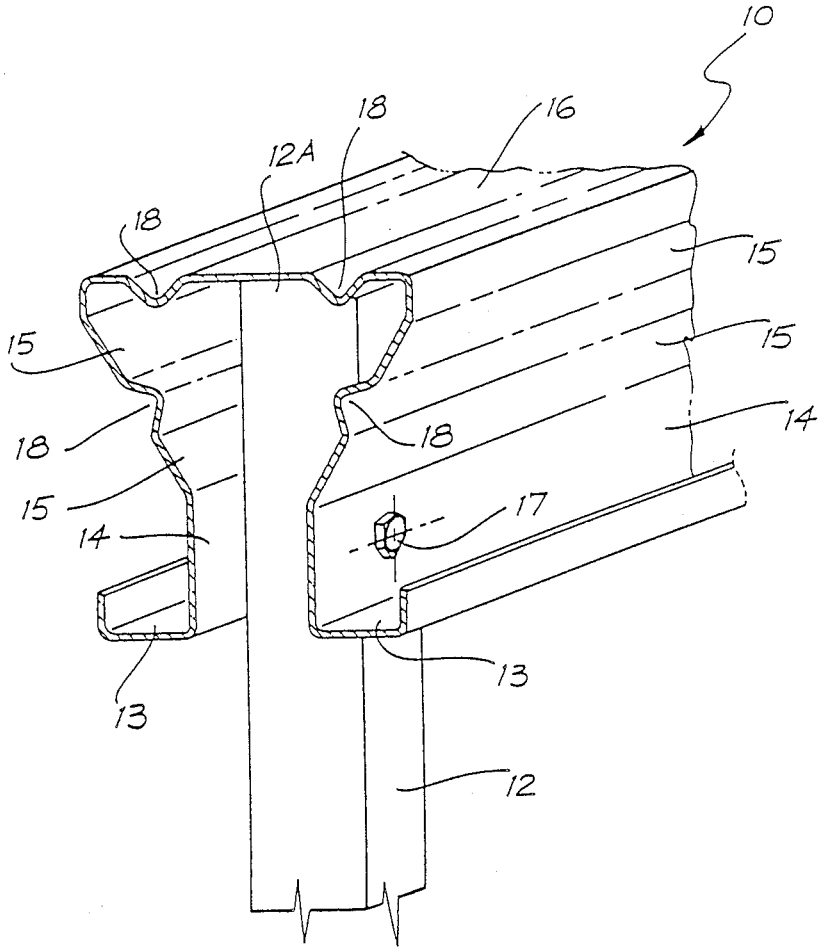
FIG. 3 shows an enlargement of detail "A" shown in FIG. 1.
Figure 6:
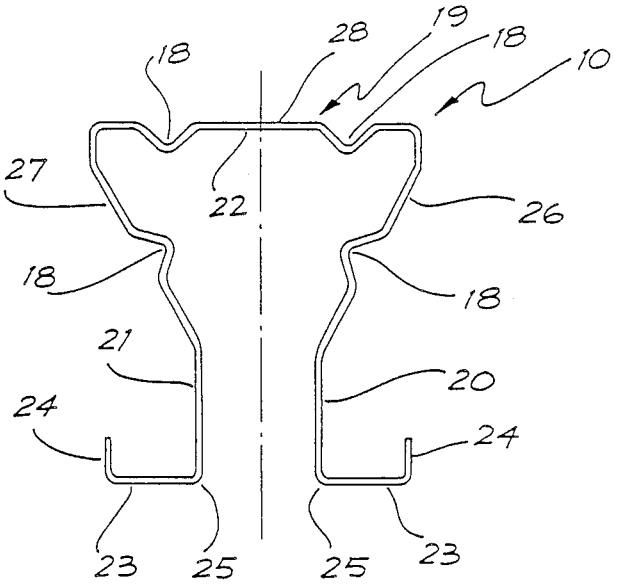
FIG. 6 is a section, drawn to scale of the beam constituting the upper chord of the truss.

Although the results of load-bearing capacity of various cross-sectional forms of the beam constructed in the above manner showed improvement over the prior conventional form of beam considered as a reference, the cross-sectional shape indicated in FIGS. 3 and 6 was found to have unexpectedly better capacity than all others. It is believed that this has principally been made possible by ensuring that no flat portion 13, 14, 15 or 16 exceeds the width as determined by the above formula while maximum use is made of reinforcing ribs 18 whereby when excessive load is imposed upon the beam breakdown of substantially all of the portions of the cross-sectional shape occurs simultaneously. That is to say that no portion of the shape exceeds the width as determined by the said equation. Furthermore, maximum usage has been made of the total width of 230 mm of the metal strip material to resist axial compressive forces on the chord 10.

In design of the beam forming the chord 10 the following features have been included for specific reasons. The chord 10 is shown in FIG. 6 in its normal position as assembled in a truss, and relative positional terms such as "upper" and "lower" used in this specification and appended claims refer to the beam disposed as shown in this drawing. As a first feature the longitudinally extending roof batten-fixing portion 19 is of a width approximating 50 mm to provide a roof fixer with a width of support providing good latitude in location of fixing means. Secondly, a pair of parallel longitudinally extending web member-fixing portions 20 and 21 require to be positioned beneath and substantially perpendicular to the portion 19. The width of the portions 20 and 21 is such as not to exceed that determined by the above formula as it is desirable not to include reinforcing ribbing, as fixing bolts for the webs 12 will be introduced through the portions 20 and 21 at intervals along the length of the chord 10. Thirdly, to avoid a tendency to buckling along an exposed edge at the bottom of the portions 20 and 21 a flange portion 23 having an outer return flange 24 is integrally formed with the edge 25 and extends outwardly substantially at right angles therefrom.

In achieving the above features the balance of the width of 230 mm of the raw metal strip is utilised in the formation of the longitudinally extending ribs 18 (FIG. 3) and a pair of longitudinally extending inclined portions 26 and 27 which interconnect the upper ends of respective ones of the parallel portions 20 and 21 to adjacent lateral edges of the upper portion 19. The chord 10 being formed from a single strip of metal, is of unitary or integral construction. The inclined portions 26 and 27 preferably include a single rib 18 which is adequate to ensure that the flat portions 15 (FIG. 3) do not exceed the width of material as determined by the above formula. In one form the upper portion 19 is 54 mm in width while each of the parallel portions 20 and 21 are 20 mm in width.

Formulas accepted by the Standards Association of Austrial have been utilised to determine the strength of the conventional beam, which has been used as a reference for the invention, as well as for a beam constructed according to the invention. The two beams were of 1.85M length formed from 300 Mpa mild steel and of a thickness of material which was 0.9 mm for the conventional beam and 0.7 mm in respect of the beam of this invention. The conventional beam was calculated to have a capacity for axial compression of 640N while the beam of the invention had a capacity of 1,025N.

Thus, the beam of the invention besides utilizing less material would be cheaper to construct as being of open section it is producable by roll forming, while being considerably stronger than the conventional reference beam. The improved strength derived from the invention will permit wider spacing of trusses where desired or may effect other economy in a roof structure employing such trusses. Where greater strength in roof structure is required in those siting locations susceptible to high winds, snow falls, and the like, a roof structure composed of trusses and upper chords therefor in compliance with the invention will be found to have benefit.

Figure 4:
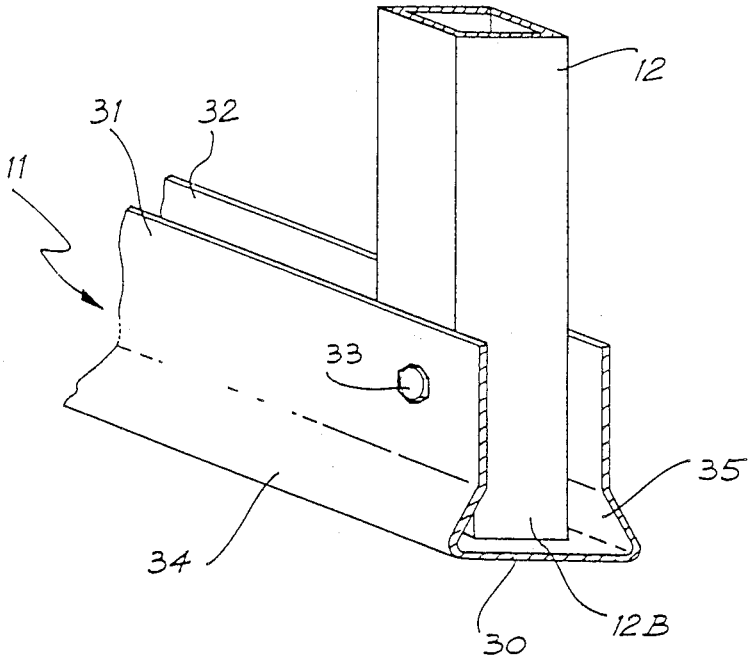
FIG. 4 shows an enlargement of detail "B" shown in FIG. 1.

As shown in FIG. 4 the lower end 12B of the webs 12 rest within lower chords 11 of the truss. In this case the chord 11 is channelled and provided with a lower longitudinally extending ceiling-fixing portion 30, and a pair of longitudinally extending parallel portions 31 and 32 spaced apart by 19 mm to straddle the web 12 and allow its end 12B to abut the innerface of the lower portion 30. Fixing bolts 33 for the web 12 are passed through the parallel portions 31 and 32. A pair of longitudinally extending inclined portions 34 and 35 join the lower edges of the portions 31 and 32 to the longitudinal edge on opposite sides of the lower portion 30. The entire chord 11 is roll formed from sheet metal.

Figure 5:
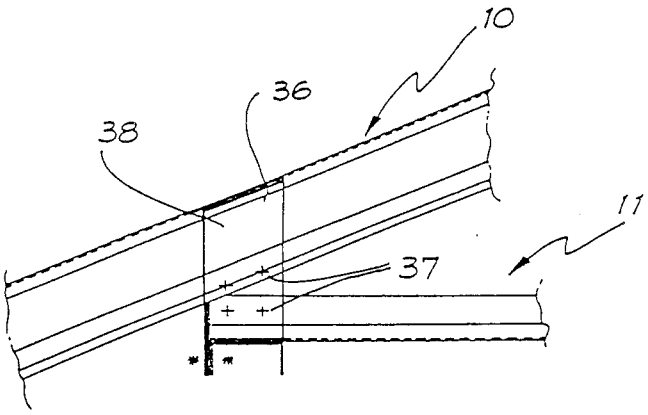
FIG. 5 shows an enlargement of detail "C" shown in FIG. 1.

FIG. 5 shows one form of a curved square tube for securing the lower chord 11 to the upper chord 10 and to the top plate (not shown) of a wall structure. Fixing of the bracket 36 is by bolts 37 and an upper portion 38 thereof penetrates into the channel of the upper chord 10.

By reducing the top chord thickness of material from 0.7 mm to 0.42 mm (500 Mpa) and adding two webs, each located within the included angle of the webs 12 on each side of the apex of the truss, further gains are made in the reduction of material and, therefore, the cost in the top chord and the truss as a whole representing a material saving in the truss of 21% on the previous embodiment described.

Whereas a preferred embodiment has been described in the foregoing passages it should be understood that other forms, modifications and refinements are feasible within the scope of this invention.

We claim:

1. A structural beam for use as an upper chord in a roof truss and composed of rolled form metal strip material having in cross-section a shape including a plurality of longitudinally extending integral portions, said beam comprising:

a first roof batten-fixing portion, a pair of parallel portions beneath and substantially perpendicular to said first portion and spaced apart less than the width of said first portion and providing means for connection to an upper end of at least one web member, a pair of portions divergingly interconnecting upper ends of respective ones of said parallel portions to adjacent lateral edges of said first portion, and flanges extending outwardly at substantially right angles from respective lower ends of said parallel portions.

2. A structural beam according to claim 1, wherein the spacing between said pair of parallel web-fixing portions corresponds to the dimension of he web members.

3. A structural beam according to claim 1, wherein said beam is formed from 300 Mpa mild steel and of a thickness of material of 0.7 mm.

4. A structural beam according to claim 1, wherein said beam is formed from 500 Mpa mild steel and of a thickness of material of 0.42 mm.

5. A roof truss comprising a lower chord, an upper chord composed of a structural beam according to claim 1 and supporting webs fixed between said lower and upper chords.

6. A structural beam for use as an upper chord in a roof truss and composed of rolled form metal strip material having in cross-section a shape including a plurality of longitudinally extending integral portions, said beam comprising a first roof batten-fixing portion, a pair of parallel portions beneath and substantially perpendicular to said first portion and spaced apart less than the width of said first portion, and providing means for connection of said chord to the upper end of one or more spaced web members, a pair of inclined portions interconnecting the upper ends of respective ones of said parallel portions to adjacent lateral edges of said first portion, a flange portion having an outer return flange and extending outwardly at substantially right angles from the lower end of each of said parallel portions, and longitudinally extending reinforcing ribs formed in said first portion and in each of said inclined portions, the design of said beam being such that with the application of excessive load upon the beam in its use as an upper chord of a roof truss breakdown of substantially all of said portions of the cross-sectional shape occurs simultaneously.

7. A structural beam according to claim 6, wherein all of said portions, or parts thereof, excepting said parallel portions, which have uninterupted flat surfaces have a width not exceeding that which will comply with the following formula:

$$F_a = \frac{\Omega F_y}{\Omega} - \left[\left(\frac{1.25 + \frac{F_{oc}}{QF_y}}{2}\right) - \sqrt{\left(\frac{1.25 + \frac{F_{oc}}{QF_y}}{2}\right)^2 - \frac{F_{oc}}{QF_y}}\right]$$

where $F_a$=maximum permissible compression stress expressed in MpA $\Omega$=load factor Q=form factor which allows for the effective cross-sectional area $F_{oc}$=elastic buckling stress expressed in Mpa $F_y$=yield stress expressed in Mpa 8. A structural beam according to claim 7, wherein said formula is used to determine the width of said flat portions as related to their thickness corresponding to the desired load-carrying capacity of said beam.

* * * * *